US010730680B2

(12) United States Patent
Kiessner et al.

(10) Patent No.: US 10,730,680 B2
(45) Date of Patent: Aug. 4, 2020

(54) RETAINING BOX TEMPLATE AND METHODS OF USE

(71) Applicant: Packsize LLC, Salt Lake City, UT (US)

(72) Inventors: Hanko Kiessner, Salt Lake City, UT (US); Niklas Pettersson, Västerås (SE)

(73) Assignee: PACKSIZE LLC, Salt Lake City, UT (US)

( * ) Notice: Subject to any disclaimer, the term of this patent is extended or adjusted under 35 U.S.C. 154(b) by 132 days.

(21) Appl. No.: 15/774,976

(22) PCT Filed: Oct. 27, 2016

(86) PCT No.: PCT/US2016/059225

§ 371 (c)(1),
(2) Date: May 9, 2018

(87) PCT Pub. No.: WO2017/083115

PCT Pub. Date: May 18, 2017

(65) Prior Publication Data

US 2018/0327164 A1 Nov. 15, 2018

Related U.S. Application Data

(60) Provisional application No. 62/253,536, filed on Nov. 10, 2015.

(51) Int. Cl.
*B65D 81/07* (2006.01)
*B65D 5/50* (2006.01)
(Continued)

(52) U.S. Cl.
CPC ..... *B65D 81/075* (2013.01); *B65D 5/4266* (2013.01); *B65D 5/5028* (2013.01); *B65D 81/07* (2013.01); *B65D 5/0236* (2013.01)

(58) Field of Classification Search
CPC .. B65D 81/07; B65D 81/075; B65D 81/1075; B65D 5/4266; B65D 5/5028; B65D 5/0236
(Continued)

(56) References Cited

U.S. PATENT DOCUMENTS 2,090,375 A 8/1937 Rosenthal et al.
5,226,542 A 7/1993 Boecker et al.
(Continued)

FOREIGN PATENT DOCUMENTS

CN 103922038 7/2014
CN 104743190 7/2015
(Continued)

OTHER PUBLICATIONS

U.S. Appl. No. 62/253,536, filed Nov. 10, 2015, Kiessner et al.
(Continued)

*Primary Examiner* — Rafael A Ortiz
(74) *Attorney, Agent, or Firm* — Workman Nydegger

(57) ABSTRACT

Foldable templates include sheet material with a front surface and a retaining element connected to the sheet material extending over at least a portion of the front surface. In box insert configurations, the sheet material has transverse and longitudinal creases, the retaining element extending across the creases. In retaining box configurations, the sheet material includes a base panel and opposing longitudinal side walls, with transverse creases extending across the base panel and side walls. In each template, folding the sheet material upward along transverse creases opens a receiving area between the front surface and retaining element to receive a product. In the box insert configuration, folding the sheet material downward underneath the front surface along transverse creases pulls the retaining element tight over the product. In the retaining box configuration, folding the side
(Continued)

walls upward flattens the transverse creases and pulls the retaining element tight over the product.

35 Claims, 12 Drawing Sheets

(51) Int. Cl.
*B65D 5/42* (2006.01)
*B65D 5/02* (2006.01)

(58) Field of Classification Search
USPC ..... 206/521, 521.1, 521.2, 524, 583, 588, 206/591, 592, 594, 477, 478
See application file for complete search history.

(56) References Cited

U.S. PATENT DOCUMENTS

| | | | | |
|---|---|---|---|---|
| 5,669,506 | A | 9/1997 | Lofgren et al. | |
| 5,678,695 | A * | 10/1997 | Ridgeway | B65D 5/5028 206/305 |
| 5,694,744 | A | 12/1997 | Jones | |
| 5,975,307 | A | 11/1999 | Harding et al. | |
| 6,289,655 | B1 | 9/2001 | Ridgeway et al. | |
| 6,467,624 | B1 | 10/2002 | Lofgren et al. | |
| 7,753,209 | B2 * | 7/2010 | McDonald | B65D 81/07 206/583 |
| 2005/0173502 | A1 * | 8/2005 | Kim | B65D 5/0005 229/101 |
| 2006/0000743 | A1 | 1/2006 | Lofgren et al. | |
| 2010/0000907 | A1 * | 1/2010 | Kashiwabara | B65D 5/5028 206/592 |
| 2011/0108450 | A1 | 5/2011 | Goodrich | |
| 2011/0240515 | A1 | 10/2011 | Ridgeway | |
| 2012/0272620 | A1 | 11/2012 | Mcdonald et al. | |
| 2014/0076769 | A1 | 3/2014 | McDonald et al. | |
| 2014/0183097 | A1 | 7/2014 | Leroy et al. | |
| 2015/0314936 | A1 * | 11/2015 | Stack, Jr. | B65D 81/07 206/488 |

FOREIGN PATENT DOCUMENTS

| | | |
|---|---|---|
| CN | 104918867 | 9/2015 |
| DE | 202010011937 | 11/2010 |
| EP | 1561693 | 8/2005 |

OTHER PUBLICATIONS

WirVerpackenZukunft, "Korrvu Fixierverpackung Retention-Box" Published Jun. 2, 2014. https://www.youtube.com/watch?v=LhSACzYNMMc.
Void Fill Packaging, "Korrvu Packaging Sealed Air" Published Sep. 2, 2011. Https://www.youtube.com/watch?v=IYg0gM138tg.
Jones, Doug "Korrvu Retention Box Folding Instructions," Published Jan. 2, 2014. https://www.youtube.com/watch?v=V5InWqSCBA4.
Bunzl Retail & Industry, "Korrvu Verpakking Bunzl," Published Jun. 24, 2013. https://www youtube.com/watch?v=EBJQXgp7ovg.
Jones, Doug,"Korrvu Clamshell Folding Instructions," Published Aug. 28, 2013. https://www.youtube.com/watch?v=m2gvDPsrGx4.
Venezim1 "Korrvu 2," Published May 10, 2012. https://www.youtube.com/watch?v=pl-eKVUbqcQ.
Artefekz, "Korrvu Postal Box Assembly www.defndapack.com," Published Sep. 18, 2013. https://www.youtube.com/watch?v=gknP2qjipKw.
Jones, Doug, "Korrvu Bottle Pack Video," Published Feb. 24, 2014. https://www.youtube.com/watch?v=0qgQEAptQ40.
Venezim 1, "Korrvu Packout 1," Published May 10, 2012. https://www.youtube.com/watch?v=eegBWo0UzOU.
Emba Protec, "Emba-Flex," http://www.emba-protec.de/en/produktvideos/emba-flex/.
PSCINTERNATIONAL's Channel, "Emba-Flex—Retaining Packaging," Published Mar. 23, 2012. https://www.youtube.com/watch?v=IgGM_Lm72Pw.
EmmPac, LLC Packaging, "Korvu Demonstration," Published Feb. 5, 2015. https://www.youtube.com/watch?v=JDwRqSaApno.
PSCINTERNATIONAL's Channel, "Emba-Quick—One-Piece Retaining Packaging," Published Mar. 23, 2012. https://www.youtube.com/watch?v=gW65FL1sVhs.
PSCINTERNATIONAL's Channel, "Emba-Protec—Protective Packaging Newest Version,"Published Mar. 23, 2012. https://www.youtube.com/watch?v=PQZavjH9UZM.
WirVerpackenZukunft, "Korrvu Retention-Box Fixierverpackung.mp4," Published Feb. 5, 2013. https://www.youtube.com/watch?v=Rt2yqr5rl0M.
Topa Verpakking, "Korrvu Laptopverpakking Topa Verpakking," Published Jan. 28, 2013. https://www.youtube.com/watch?v=J_rooi5V24E.
International Search Report for PCT/US16/59225 dated Jan. 3, 2017.
International Search Report and Written Opinion, PCT/US2016/059225, dated Jan. 3, 2017, United States International Search Authority.

* cited by examiner

RETAINING BOX TEMPLATE AND METHODS OF USE

CROSS-REFERENCE TO RELATED APPLICATIONS

This application claims priority to PCT Application No. PCT/US2016/059225, filed Oct. 27, 2016, entitled "RETAINING BOX TEMPLATE AND METHODS OF USE", which claims the benefit of and priority to U.S. Provisional Application No. 62/253,536, filed Nov. 10, 2015, and entitled "RETAINING BOX TEMPLATE AND METHODS OF USE". All the aforementioned applications are incorporated by reference herein in their entirety.

BACKGROUND

1. Technical Field

Exemplary embodiments of the present disclosure relate to packaging. More specifically, embodiments of the present disclosure relate to packaging templates that may be assembled, incorporated, and/or inserted into a box, and to methods of performing the same.

2. The Relevant Technology

In many industries, packaging materials are used to deliver products to clients. Often such packaging materials take the form of boxes in which the item(s) are placed for delivery. Such boxes may, of course, be of virtually any size and configuration. It may be that the product is placed directly inside the box without any additional material. In such cases, an item may move around within the box or contact another item and become damaged or destroyed thereby. Accordingly, steps are often taken to protect the product against excessive movement within the box.

For instance, when a product is placed directly inside of a box, care is often taken to select a box that has dimensions that generally correspond to the dimensions of the product being boxed so that the product fits snugly within the box. Such may be desirable to prevent excess movement of the product and, consequently, reduce the shaking or movement of the product therein. The dimensions of standard sized boxes, however, often do not correspond to the size of the products being packaged therein. As a result, the products being packaged routinely do not fit snugly into standard-sized boxes.

To avoid excessive movement of the packaged product in such cases, some additional material may be provided around the product to reduce movement of the product within the box. For instance, foam peanuts, bags of air, bubble-wrap, and the like may be used to protect a fragile or other product. Thus, the product may be cushioned or otherwise protected from being damaged or destroyed.

Packaging items in boxes that are too large or that require additional cushioning may be costly and inefficient. For instance, the additional material used in creating the larger packages and in cushioning items packaged therein increases the cost of packaging the product. Furthermore, storing a large assortment of premade boxes of various sizes can require significant amounts of storage space that could otherwise be eliminated or more efficiently used. Moreover, packages that are too large for a particular item are more expensive to ship. Shipping prices are often affected by the size of the shipped package, and not just the weight of the package. Thus, reducing the size of an item's package may reduce the price of shipping the item in certain situations.

On the other hand, buying boxes and other shipping materials in bulk may save on costs and labor. For instance, buying a large assortment of box sizes in order to accommodate a variety of product sizes may be more expensive in the long run than simply buying a bulk lot of a single size of box large enough to ship any size of product to be shipped.

One attempt to avoid such costs and inefficiencies has been to develop systems for creating custom sized boxes on-demand. Such systems create templates out of a planar material which may be folded to form boxes. The template includes sections (or panels) that fold along creases to form the top, bottom, and sidewalls of the box. Importantly, the planar material may be stored as a fan-fold bale, which reduces space required to store packaging materials. However, such custom box templates require additional time and resources to design and create a new box template for each item to be shipped.

In addition, while customized boxes and additional packaging materials may be effective in protecting a product enclosed in the box, they often fail to retain the product in an optimal position once the box is opened. For instance, inserted packaging materials may conceal the product from view when the box is opened upon arrival—detracting from the initial presentation of the product. Inserted packaging materials may also fall out the opened box, allowing the product to shift or even drop out of the box. In some cases a deliberate distance between the product and the surrounding transport packaging is needed in a few or all directions to ensure the product is not damaged due to vibrations, g-forces and/or deformations/dents to the transport packaging.

Presentation inserts and box elements designed to overcome these additional problems often resurrect one or more of the aforementioned problems. For instance, the presentation inserts and box elements may be designed for a single or small window of size applications as opposed to being customizable. In addition, it can be cumbersome to insert or otherwise arrange the product into such presentation inserts and box elements. Furthermore, retaining the presentation material in a secured configuration often requires complex procedures that can be time-consuming to learn and execute. In view of the foregoing, one may be left to choose between suboptimal solutions to a complex problem.

Although the above-described solutions may reduce some of the costs and inefficiencies associated with packaging and shipping with boxes, there are still some inefficiencies that may be addressed.

BRIEF SUMMARY OF THE INVENTION

This disclosure relates to packaging templates that may be assembled, incorporated, and/or inserted into a box and to methods of performing the same. In particular, embodiments described herein include a foldable template that includes a sheet material and a product retaining element connected thereto. The sheet material can have a plurality of creases with the retaining element disposed atop (or over) a surface of the sheet material and spanning and/or extending across (or over) at least a portion of the plurality of creases. The template or sheet material thereof can be foldable into a box or foldable into a box insert. Accordingly, the template can retain and/or display the product within the box when the box is opened.

In a box insert configurations, for example, the sheet material can have a plurality of transverse creases and a plurality of longitudinal creases. In a retaining box configuration, for example, the sheet material can include a base panel and one or more longitudinal side wall panels, with one or more transverse creases extending across the base panel and side wall panel(s). In each template, folding the sheet material upward along one or more transverse creases can open a receiving area between a portion of the front surface of the sheet material (or base panel) and a portion of the retaining element in order to receive a product therebetween. In the box insert configuration, folding the sheet material downward underneath the front surface along at least one transverse crease can pull the retaining element tight over the product. In the retaining box configuration, folding the side wall(s) upward can flatten the one or more transverse creases and can pull the retaining element tight over the product.

In one embodiment, a foldable template for forming a product retaining box can include a sheet material having a front surface, and comprising a base panel, at least a first side wall panel, at least a first longitudinal crease, a first transverse crease, and/or an optional second transverse crease. The base panel can have a perimeter comprising a first transverse edge, a second transverse edge (opposite the first transverse edge), an upper longitudinal edge (extending between the first and second transverse edges), and/or a lower longitudinal edge (extending between the first and second transverse edges opposite the upper longitudinal edge). The first side wall panel can be connected to the base panel and/or can extend from the upper longitudinal edge. The first longitudinal crease can be disposed between the base panel and the first side wall panel.

The first transverse crease can be disposed on the base panel and/or side wall panel(s). For instance, the first transverse crease can be disposed between the first and second transverse edges of the base panel and can extend from the lower longitudinal edge across the first longitudinal crease and into the first side wall panel. Some embodiments can include first and second transverse creases separated by a first longitudinal length, with the first and second transverse creases being disposed between the first and second transverse edges of the base panel and extending from the lower longitudinal edge across the first longitudinal crease and into the first side wall panel. An area on the front surface (e.g., between the first and second transverse creases and/or between the upper and lower longitudinal edges can comprise a product receiving area.

The foldable template also includes a retaining element connected to the sheet material. The retaining element can be disposed over at least a portion of the front surface and/or can extend across the first (and optional second) transverse crease. In such a configuration, folding the sheet material along the first (and optional second) transverse crease can increase the distance between the retaining element and the receiving area. In addition, unfolding the sheet material along the first (and optional second) transverse crease such that the base panel is in a planar configuration can decrease the distance between the retaining element and the receiving area. Moreover, folding the sheet material along the first longitudinal crease such that the first side wall panel is oriented perpendicular to the base panel can retain the base panel in the planar configuration.

Another embodiment includes a method of retaining a product in a box. The method can include providing a foldable template (e.g., one of the foldable templates described herein), folding the sheet material along at least a first transverse crease thereby increasing the distance between a portion of the retaining element and the front surface of the sheet material, placing a product in the receiving area between the portion of the retaining element and the front surface of the sheet material, flattening the sheet material along the first transverse crease such that the base panel is in a substantially planar configuration thereby decreasing the distance between the portion of the retaining element and the front surface of the sheet material such that the retaining element is stretched over the product as the base panel and/or sheet material is flattened, and/or folding the sheet material at the first longitudinal crease such that the first side wall panel is folded upward towards the front surface into an erected configuration thereby retaining the base panel in the substantially planar configuration.

In another embodiment, the sheet material can include the base panel, a lid panel connected to the base panel and extending from the first transverse edge, an end wall panel disposed between the base panel and the lid panel, a front wall panel connected to the base panel and extending from the second transverse edge opposite the end wall panel, a securing flap connected to the front wall panel opposite the base panel, a third transverse crease disposed between the base panel and the front wall panel, a fourth transverse crease disposed between the front wall panel and the securing flap, a fifth transverse crease disposed between the base panel and the end wall panel, and/or a sixth transverse crease disposed between the end wall panel and the lid panel. The retaining element can also extend across the first and second and third and fifth transverse creases.

A further embodiment includes another method of retaining a product in a box. The method can include providing a foldable template (e.g., one of the foldable templates described herein), bending the sheet material at one or more of the first and second transverse creases thereby increasing the distance between a portion of the retaining element and the front surface of the sheet material, placing a product in the receiving area between a portion of the retaining element and the front surface of the sheet material, manipulating the sheet material such that the retaining element secures the product against the front surface, wherein manipulating the sheet material can comprise flattening the base panel at the first and second transverse creases such that the base panel is substantially planar thereby decreasing the distance between the portion of the retaining element and the front surface of the sheet material such that the retaining element is stretched over the product as the base panel is flattened, folding the sheet material at the first and second longitudinal creases such that the first and second side wall panels are folded upward towards the front surface into an erected configuration thereby retaining the base panel in a flattened configuration, folding the sheet material at the third transverse crease such that the front wall panel is folded upward towards the front surface into an erected configuration, and/or folding the securing flap downward towards the front surface substantially against the front wall panel thereby securing the first and second side wall panels and the front wall panel in the respective erected configurations.

In yet another embodiment, a foldable template for forming a customized product retainer box insert configured to retain products of various sizes can include a sheet material having a base format with a substantially rectangular shape, opposing front and back surfaces, and/or a plurality of longitudinal creases extending between opposing first and second sides of the sheet material. The plurality of longitudinal creases can include a pair of outer longitudinal creases and at least one inner longitudinal crease disposed between the opposing outer longitudinal creases. The sheet material can also include a plurality of transverse creases extending between opposing upper and lower sides of the sheet material. The plurality of transverse creases can include a pair of outer transverse creases and at least one inner transverse crease disposed between the opposing outer transverse creases. The foldable template can also include a retaining element connected to the sheet material. The retaining element can be disposed over at least a portion of the front surface and/or can extend across the plurality of longitudinal creases and/or the plurality of transverse creases. In some embodiments, folding the sheet material along one or more of the creases in a first direction can increase the distance between the retaining element and the front surface of the sheet material. Similarly, folding the sheet material along one or more of the creases in a first direction can decrease the distance between the retaining element and the front surface of the sheet material Yet a further embodiment includes a method of retaining a product in a customized product retainer box insert configured to retain products of various sizes. The method can include providing a foldable template (e.g., as described herein), placing a product between a portion of the retaining element and the front surface of the sheet material, selecting from among the plurality of transverse creases a first selected transverse crease disposed peripheral to a first side of the product and a second selected transverse crease disposed peripheral to a second side of the product opposite the first side of the product, and/or manipulating the sheet material such that the retaining element secures the product against the front surface, wherein manipulating the sheet material comprises folding the sheet material at the first selected transverse crease and the second selected transverse crease such that a first portion of the sheet material peripheral to the first selected transverse crease and a second portion of the sheet material peripheral to the second selected transverse crease are folded substantially against the back surface. In at least some embodiments, manipulating the sheet material can stretch the retaining element over the product as the sheet material is folded at the first selected transverse crease and the second selected transverse crease.

These and other objects and features of the present disclosure will become more fully apparent from the following description and appended claims, or may be learned by the practice of the disclosure as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION

Figure 1:
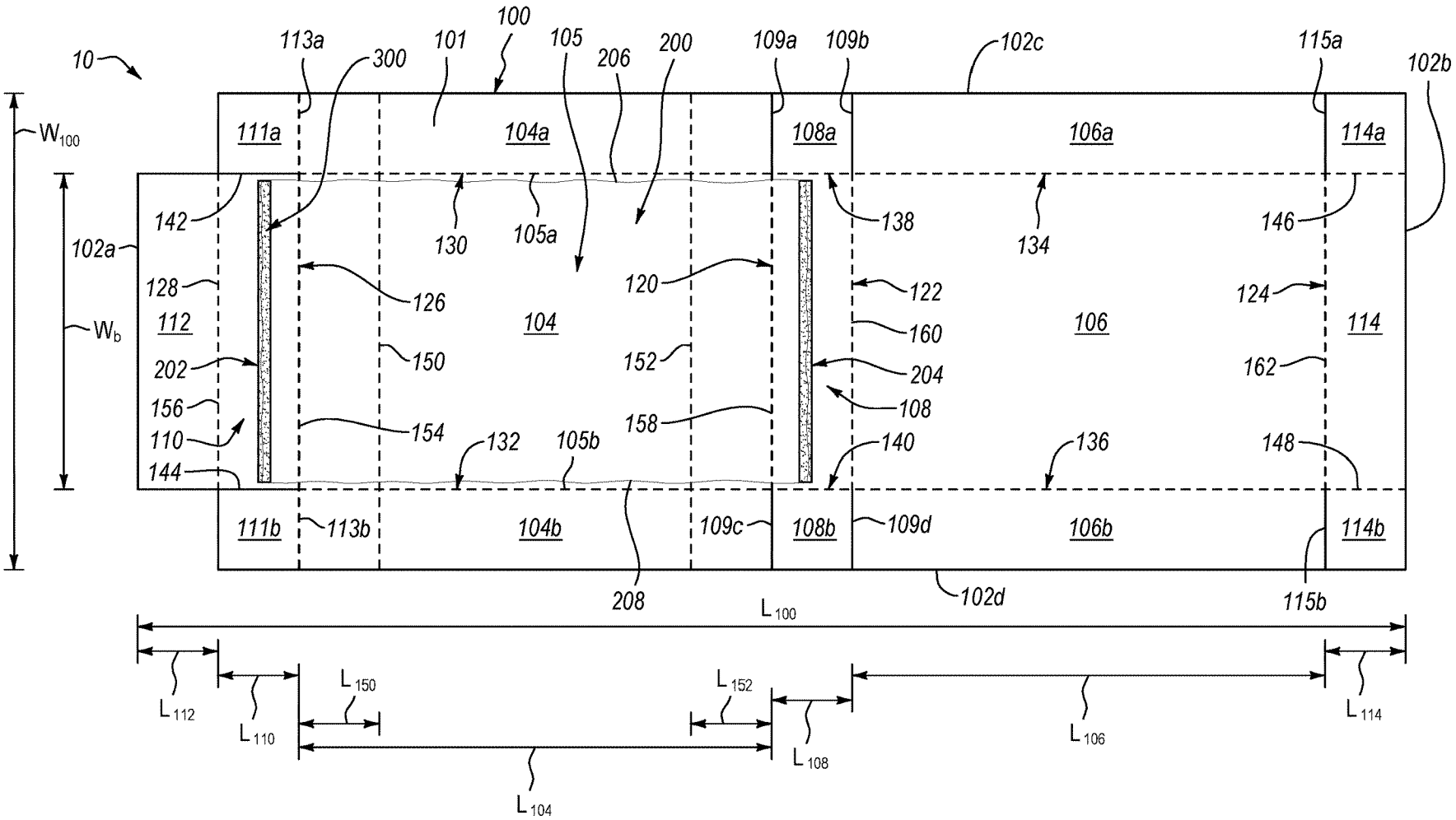
FIG. 1 illustrates a top plan view of a foldable retaining box template according to an exemplary embodiment of the present disclosure.

Before describing the present disclosure in detail, it is to be understood that this disclosure is not limited to the specific parameters or configurations of the particularly exemplified systems, apparatus, assemblies, products, devices, kits, methods, and/or processes, which may, of course, vary. It is also to be understood that much, if not all of the terminology used herein is only for the purpose of describing particular embodiments of the present disclosure, and is not necessarily intended to limit the scope of the disclosure in any particular manner. Thus, while the present disclosure will be described in detail with reference to specific configurations, embodiments, and/or implementations thereof, the descriptions are illustrative only and are not to be construed as limiting the scope of the claimed invention. Accordingly, various modifications can be made to the present disclosure without departing from the spirit and scope of the invention as defined by the claims.

Various aspects of the present disclosure, including devices, systems, methods, etc., may be illustrated with reference to one or more exemplary embodiments or implementations. As used herein, the terms "exemplary embodiment" and/or "exemplary implementation" means "serving as an example, instance, or illustration," and should not necessarily be construed as preferred or advantageous over other embodiments or implementations disclosed herein. In addition, reference to an "implementation" of the present disclosure or invention includes a specific reference to one or more embodiments thereof, and vice versa, and is intended to provide illustrative examples without limiting the scope of the invention, which is indicated by the appended claims rather than by the following description.

Furthermore, unless defined otherwise, all technical and scientific terms used herein have the same meaning as commonly understood by one of ordinary skill in the art to which the present disclosure pertains. While a number of methods, materials, components, etc. similar or equivalent to those described herein can be used in the practice of the present disclosure, only certain exemplary methods, materials, components, etc. are described herein.

It will be noted that, as used in this specification and the appended claims, the singular forms "a," "an" and "the" include plural referents unless the content clearly dictates otherwise. Thus, for example, reference to a "crease" includes one, two, or more creases. Similarly, reference to a plurality of referents should be interpreted as comprising a single referent and/or a plurality of referents unless the content and/or context clearly dictate otherwise. Thus, reference to "creases" does not necessarily require a plurality of such creases. Instead, it will be appreciated that independent of conjugation; one or more creases are contemplated herein.

As used throughout this application the words "can" and "may" are used in a permissive sense (i.e., meaning having the potential to), rather than the mandatory sense (i.e., meaning must). Additionally, the terms "including," "having," "involving," "containing," "characterized by," as well as variants thereof (e.g., "includes," "has," and "involves," "contains," etc.), and similar terms as used herein, including the claims, shall be inclusive and/or open-ended, shall have the same meaning as the word "comprising" and variants thereof (e.g., "comprise" and "comprises"), and do not exclude additional, un-recited elements or method steps, illustratively.

Various aspects of the present disclosure can be illustrated by describing components that are coupled, attached, connected, and/or joined together. As used herein, the terms "coupled", "attached", "connected," and/or "joined" are used to indicate either a direct association between two components or, where appropriate, an indirect association with one another through intervening or intermediate components. In contrast, when a component is referred to as being "directly coupled", "directly attached", "directly connected," and/or "directly joined" to another component, no intervening elements are present or contemplated. Thus, as used herein, the terms "connection," "connected," and the like do not necessarily imply direct contact between the two or more elements. In addition, components that are coupled, attached, connected, and/or joined together are not necessarily (reversibly or permanently) secured to one another. For instance, coupling, attaching, connecting, and/or joining can comprise placing, positioning, and/or disposing the components together or otherwise adjacent in some implementations.

As used herein, directional and/or arbitrary terms, such as "top," "bottom," "front," "back," "forward," "rear," "left," "right," "up," "down," "upper," "lower," "inner," "outer," "internal," "external," "interior," "exterior," "anterior," "posterior," "proximal," "distal," and the like can be used only for convenience and/or solely to indicate relative directions and/or orientations and may not otherwise be intended to limit the scope of the disclosure, including the specification, invention, and/or claims. According, such directional and/or arbitrary terms are not to be construed as necessarily requiring a specific order or position.

To facilitate understanding, like reference numerals have been used, where possible, to designate like elements common to the figures. Furthermore, alternative configurations of a particular element may each include separate letters appended to the element number. Accordingly, an appended letter can be used to designate an alternative design, structure, function, implementation, and/or embodiment of an element or feature without an appended letter. Similarly, multiple instances of an element and or sub-elements of a parent element may each include separate letters appended to the element number. In each case, the element label may be used without an appended letter to generally refer to instances of the element or any one of the alternative elements. Element labels including an appended letter can be used to refer to a specific instance of the element or to distinguish or draw attention to multiple uses of the element. However, element labels including an appended letter are not meant to be limited to the specific and/or particular embodiment(s) in which they are illustrated. In other words, reference to a specific feature in relation to one embodiment should not be construed as being limited to applications only within said embodiment.

Various modifications can be made to the illustrated embodiments without departing from the spirit and scope of the invention as defined by the claims. Thus, while various aspects and embodiments have been disclosed herein, other aspects and embodiments are contemplated. It is also noted that systems, apparatus, assemblies, products, devices, kits, methods, and/or processes, according to certain embodiments of the present disclosure may include, incorporate, or otherwise comprise properties, features, components, members, and/or elements described in other embodiments disclosed and/or described herein. Thus, reference to a specific feature in relation to one embodiment should not be construed as being limited to applications only within said embodiment.

The headings used herein are for organizational purposes only and are not meant to be used to limit the scope of the description or the claims Exemplary embodiments of the present disclosure generally relate to packaging templates that may be assembled, incorporated, and/or inserted into a box, and to methods of performing the same. In particular, embodiments described herein include a foldable template that includes a sheet material and a product retaining element connected thereto. The sheet material can have a plurality of creases with the retaining element disposed atop (or over) a surface of the sheet material and spanning and/or extending across (or over) at least a portion of the plurality of creases. The template or sheet material thereof can be foldable into a box or foldable into a box insert. Accordingly, the template can retain and/or display the product within the box when the box is opened.

In a box insert configurations, for example, the sheet material can have a plurality of transverse creases and a plurality of longitudinal creases. In a retaining box configuration, for example, the sheet material can include a base panel and one or more longitudinal side wall panels, with one or more transverse creases extending across the base panel and side wall panel(s). In each template, folding the sheet material upward along one or more transverse creases can open a receiving area between a portion of the front surface of the sheet material (or base panel) and a portion of the retaining element in order to receive a product therebetween. In the box insert configuration, folding the sheet material downward underneath the front surface along at least one transverse crease can pull the retaining element tight over the product. In the retaining box configuration, folding the side wall(s) upward can flatten the one or more transverse creases and can pull the retaining element tight over the product.

As used herein, the term "template" refers to a flat stock of material that can be folded into a box or box insert. A template may have cuts, notches, cutouts, divides, and/or creases that allow the template to be bent and/or folded into a box or box insert. Additionally, a template may be made from any suitable material, generally known to those skilled in the art. For example, cardboard or corrugated paperboard may be used as the template material. Such template materials may have any suitable dimensions (i.e., length, width, thickness, etc.), weight, and/or rigidity/strength to permit the template to be bent and/or folded into a box or box insert.

As used herein, the term "crease" shall refer to a line along which any portion of the template may be folded. For example, a crease may be an indentation in the template material, which may facilitate the folding of a portion of the template that is adjacent to the crease. A suitable indentation may be created by applying sufficient pressure to reduce the thickness of the material in the desired location and/or by removing some of the material along the desired location, such as by scoring.

The terms "notch," "cutout," and "cut" are used interchangeably herein and shall refer to a shape made by removing material from the template or by separating one portion of the template material from another portion, such that an incision is made through the template.

Reference will also be made herein to two or more aligned creases. As used herein, "aligned" and similar terms do not necessarily imply exact planar, linear, and/or axial alignment and does not necessarily require the same or identical plane, line, and/or axis. Accordingly, creases may deviate from exact planar, linear, and/or axial alignment without necessarily becoming misaligned. Rather, substantially aligned creases can still be aligned in at least some embodiments described herein.

Reference will also be made herein to one or more products. As used herein, a product includes one or more items, goods, or other objects. Reference to a "product" should be interpreted as comprising a single object and/or a plurality of objects. Similarly, reference to "products" does not necessarily require a plurality of such objects. Instead, it will be appreciated that independent of conjugation; one or more objects are contemplated herein.

Accordingly, the packaging templates described herein can be folded at the positions of the creases to produce structural components or aspects of a (custom) box or box insert that retains a product. For instance, the folded panels, flaps, and/or tabs described herein can produce one or more of the side walls, top, bottom, etc. of the box, or can comprise reinforcing, securing, or locking features thereof.

Those skilled in the art will appreciate that the packaging templates can be assembled into a box in a variety of ways, methods, and/or mechanisms. For instance, the creased and/or cut flaps and/or tabs can be folded to produce the side walls of a box having a hingedly-opening and/or flap-tucking upper top and/or lid. Furthermore, flaps and/or tabs extending (seamlessly) outward from one or more panels can be folded inward (e.g., to a 90 degree angle relative to the wall from which it extends).

Reference will now be made to the figures to describe various aspects of example embodiments of the disclosure. It is to be understood that some of the drawings included herewith, and which are referenced herein, are diagrammatic, schematic, and other representations of example embodiments, and are not limiting on the present disclosure. Moreover, while various drawings are provided at a scale that is considered functional for some embodiments, the drawings are not necessarily drawn to scale for all contemplated embodiments. No inference should therefore be drawn from the drawings as to the necessity of any scale. Rather, the proportionality, scale, size, shape, form, function, and/or other feature of the disclosed embodiments can be altered without necessarily departing from the scope of this disclosure (unless such feature is expressly described herein as essential).

Furthermore, as indicated above, in the exemplary embodiments illustrated in the figures, like structures will be provided with similar reference designations, where possible. Specific language will be used herein to describe the exemplary embodiments. Nevertheless it will be understood that no limitation of the scope of the disclosure is thereby intended. Rather, it is to be understood that the language used to describe the exemplary embodiments is illustrative only and is not to be construed as limiting the scope of the disclosure (unless such language is expressly described herein as essential).

Alterations and further modifications of the inventive features illustrated herein, and additional applications of the principles illustrated herein, which would occur to one skilled in the relevant art and having possession of this disclosure, are to be considered within the scope of this disclosure. Unless a feature is described as requiring another feature in combination therewith, any feature herein may be combined with another feature of a same or different embodiment disclosed herein. Furthermore, various well-known aspects of illustrative systems, methods, apparatus, and the like are not described herein in particular detail in order to avoid obscuring aspects of the example embodiments.

It is noted that between each adjacent element of the packaging templates disclosed herein, where one element is designed to be folded relative to the other, such as between adjacent panels or between a panel and an adjacent tab or flap, a crease or cut may be formed in the sheet material so as to enable smooth and straight folding between the elements. Creases are identified in the figures with broken/dashed lines, and cuts are identified with bold/solid lines. However, it will be appreciated that in certain alternative embodiments, one or more creases can be replaced by a notch and/or one or more notches can be replaced by a crease.

FIG. 1 illustrates an exemplary embodiment of a foldable template 10 having a longitudinal length $L_{100}$ (extending between a first transverse or side edge 102*a* and an opposing second transverse or side edge 102*b*) and a transverse width $W_{100}$ (extending between an upper longitudinal edge 102*c* and an opposing lower longitudinal side edge 102*d*). Foldable template 10 can be useful for forming a product retaining box (see e.g., FIGS. 3C and 3D) and can include a sheet material 100 having a front surface 101. Template 10 can comprise a base panel 104, a first side wall panel 104*a* connected to base panel 104, a first longitudinal crease 105*a* disposed between base panel 104 and first side wall panel 104*a*, a first transverse crease 150, and/or an optionally second transverse crease 152. Base panel 104 can have a perimeter comprising a first transverse edge 120, a second transverse edge 126 (opposite first transverse edge 120), an upper longitudinal edge 130 (extending between first transverse edge 120 and second transverse edge 126), and/or a lower longitudinal edge 132 (extending between first transverse edge 120 and second transverse edge 126 opposite upper longitudinal edge 130). First side wall panel 104*a* can extend from upper longitudinal edge 130.

In some embodiments, first transverse crease 150 and/or second transverse crease 152 can extend from lower longitudinal edge 132, across first longitudinal crease 105*a*, and (entirely or partially) through first side wall panel 104*a*. Sheet material 100 can also include a second side wall panel 104*b* connected to base panel 104 and extending from lower longitudinal edge 132. A second longitudinal crease 105*b* can be disposed between base panel 104 and second side wall panel 104*b*. In some embodiments, first transverse crease 150 and/or second transverse crease 152 can extend from first side wall panel 104*a*, across first longitudinal crease 105*a*, across lower longitudinal edge 132, and (entirely or partially) through second side wall panel 104*b*. In addition, in some embodiments, a product receiving area 105 of template 10 can be defined and/or be at least partially bound by first transverse crease 150, second transverse crease 152, first longitudinal crease 105*a*, and/or second longitudinal crease 105*b*.

Sheet material 100 can also include a front wall panel 110 connected to base panel 104 and extending from second transverse edge 126, a securing flap 112 connected to front wall panel 110 and extending from side edge 128 thereof (opposite base panel 104), a third transverse crease 154 disposed between base panel 104 and front wall panel 110, and/or a fourth transverse crease 156 disposed between front wall panel 110 and securing flap 112.

Sheet material 100 can also include a first side wall tab 111*a* extending from first side wall panel 104*a* (adjacent front wall panel 110) and/or a first tab crease 113*a* disposed between first side wall tab 111*a* and first side wall panel 104*a*. In at least one embodiment, first tab crease 113*a* can be substantially aligned with third transverse crease 154. In other embodiments, third transverse crease 154 can extend across the interface between first side wall tab 111*a* and first side wall panel 104*a* (such that no additional first tab crease 113*a* may be required). A cut 142 can substantially separate and/or disconnect first side wall tab 111*a* and front wall panel 110. Sheet material 100 can also include a second side wall tab 111*b* extending from second side wall panel 104*b* and/or a second tab crease 113*b* disposed between second side wall tab 111*b* and second side wall panel 104*b*. In at least one embodiment, second tab crease 113*b* can be substantially aligned with third transverse crease 154. In other embodiments, third transverse crease 154 can extend across the interface between second side wall tab 111*b* and second side wall panel 104*b* (such that no additional first tab crease 113*b* may be required). A cut 144 can substantially separate and/or disconnect second side wall tab 111*b* and front wall panel 110.

Sheet material 100 can also include an end wall panel 108 connected to base panel 104 and extending from first transverse edge 120, a lid panel 106 connect to end wall panel 108 and extending opposite base panel 104 (such that end wall panel 108 is disposed between base panel 104 and lid panel 106), a fifth transverse crease 158 disposed between base panel 104 and end wall panel 108, and/or a sixth transverse crease 160 disposed between end wall panel 108 and lid panel 106. Lid panel 106 can have a perimeter comprising a first transverse edge 122, a second transverse edge 124 (opposite first transverse edge 122), an upper longitudinal edge 134 (extending between first transverse edge 122 and second transverse edge 124), and/or a lower longitudinal edge 136 (extending between first transverse edge 122 and second transverse edge 124, and opposite upper longitudinal edge 134).

Sheet material 100 can also include one or more lid flaps connected to and/or extending from lid panel 106. For instance, a first longitudinal lid flap 106*a* can extend from first longitudinal edge 134, a second longitudinal lid flap 106*b* can extend from second longitudinal edge 136, and/or a transverse lid flap 114 can extend from second transverse edge 124. In at least one embodiment, a seventh transverse crease 162 can be disposed between lid panel 106 and transverse lid flap 114 (e.g., extending from first longitudinal lid flap 106*a* to second longitudinal lid flap 106*b*). A first lid flap tab 114*a* can extend from an upper edge 146 of transverse lid flap 114. A cut 115*a* can substantially separate and/or disconnect first lid flap tab 114*a* and first longitudinal lid flap 106*a*. A second lid flap tab 114*b* can extend from a lower edge 148 of transverse lid flap 114. A cut 115*b* can substantially separate and/or disconnect second lid flap tab 114*b* and second longitudinal lid flap 106*b*.

Sheet material 100 can also include a first end wall tab 108*a* extending from an upper end 138 of end wall panel 108. A cut 109*a* can substantially separate and/or disconnect first end wall tab 108*a* and first side wall panel 104*a*. A cut 109*b* can substantially separate and/or disconnect first end wall tab 108*a* and longitudinal lid flaps 106*a*. Sheet material 100 can also include a second end wall tab 108*b* extending from a lower end 140 of end wall panel 108 opposite first end wall tab 108*a*. A cut 109*c* can substantially separate and/or disconnect second end wall tab 108*b* and second side wall panel 104*b*. A cut 109*d* can substantially separate and/or disconnect second end wall tab 108*b* and longitudinal lid flaps 106*b*.

First longitudinal crease 105*a* can extend longitudinally across the first side of sheet material 100 (e.g., between base panel 104 and first side wall panel 104*a*, between end wall panel 108 and first end wall tab 108*a*, between lid panel 106 and first longitudinal lid flap 106*a*, and/or between transverse lid flap 114 and first lid flap tab 114*a*. Second longitudinal crease 105*b* can extend longitudinally across the second side of sheet material 100 (e.g., between base panel 104 and second side wall panel 104*b*, between end wall panel 108 and second end wall tab 108*b*, between lid panel 106 and second longitudinal lid flap 106*b*, and/or between transverse lid flap 114 and second lid flap tab 114*b*.

In at least one embodiment, securing flap 112, front wall panel 110, base panel 104, end wall panel 108, lid panel 106, and/or transverse lid flap 114 can all have the same width $W_b$. Base panel 104 can have a length $L_{104}$, which can be substantially the same or similar to a length $L_{106}$ of lid panel 106. Similarly, a length $L_{112}$ of securing flap 112, a length $L_{110}$ of front wall panel 110, a length $L_{150}$ between crease 150 and crease 154, a length $L_{152}$ between crease 152 and crease 158, a length $L_{108}$ of end wall panel 108, and/or a length $L_{114}$ of lid flap 114 can be substantially the same or similar.

Template 10 can also include a retaining element 200 connected to sheet material 100. In at least some embodiments, retaining element 200 can comprise a non-opaque material, such as a clear, polymeric stretch film. It will be appreciate, however, that translucent materials and/or polymeric sheets are also contemplated herein. In some embodiments, retaining element 200 can have elastomeric properties suitable for being stretched in at least one (longitudinal) direction.

Retaining element 200 can be attached to any suitable portion of sheet material 100, can be disposed over at least a portion of front surface 101 (e.g., receiving area 105), and/or can extend across first transverse crease 150 (and optional second transverse crease 152). For instance, as depicted in FIG. 1, a first portion 202 of retaining element 200 can be attached to front wall panel 110 on front surface 101 of sheet material 100. A second portion 204 of retaining element 200 can be attached to end wall panel 108 on front surface 101 of sheet material 100. It will be appreciated, however, that first portion 202 of retaining element 200 can alternatively be attached to base panel 104 (e.g., between first transverse crease 150 and first transverse edge 126) or securing flap 112 (e.g., on front surface 101). It will also be appreciated that first portion 202 of retaining element 200 can alternatively be attached to an opposing rear surface of sheet material 100. Similarly, second portion 204 of retaining element 200 can alternatively be attached to base panel 104 (e.g., between second transverse crease 152 and first transverse edge 120) or lid panel 106 or lid flap 114 extending therefrom.

In addition, in at least one embodiment, at least one longitudinal side edge 206, 208 of retaining element 200 can be substantially unattached to sheet material 100 (e.g., between first transverse crease 150 and second transverse crease 152 and/or between first and second portions 202, 204). Retaining element 200 can be attached to sheet material 100 by means of at least one fastener 300. As depicted in FIG. 1, fastener 300 can comprise an adhesive (e.g., such as a glue or adhesive tape). Fastener 300 can alternatively comprise a clamp, rivet, staple, or any other suitable fastener as known to those skilled in the art.

In certain embodiments, retaining element 200 and/or longitudinal side edges 206, 208 thereof, does not extend beyond one or more of upper longitudinal edge 130 and lower longitudinal edge 132. However, retaining element 200 and/or longitudinal side edges 206, 208 thereof, may extend beyond one or more of upper longitudinal edge 130 and lower longitudinal edge 132 in other embodiments.

Figure 2:
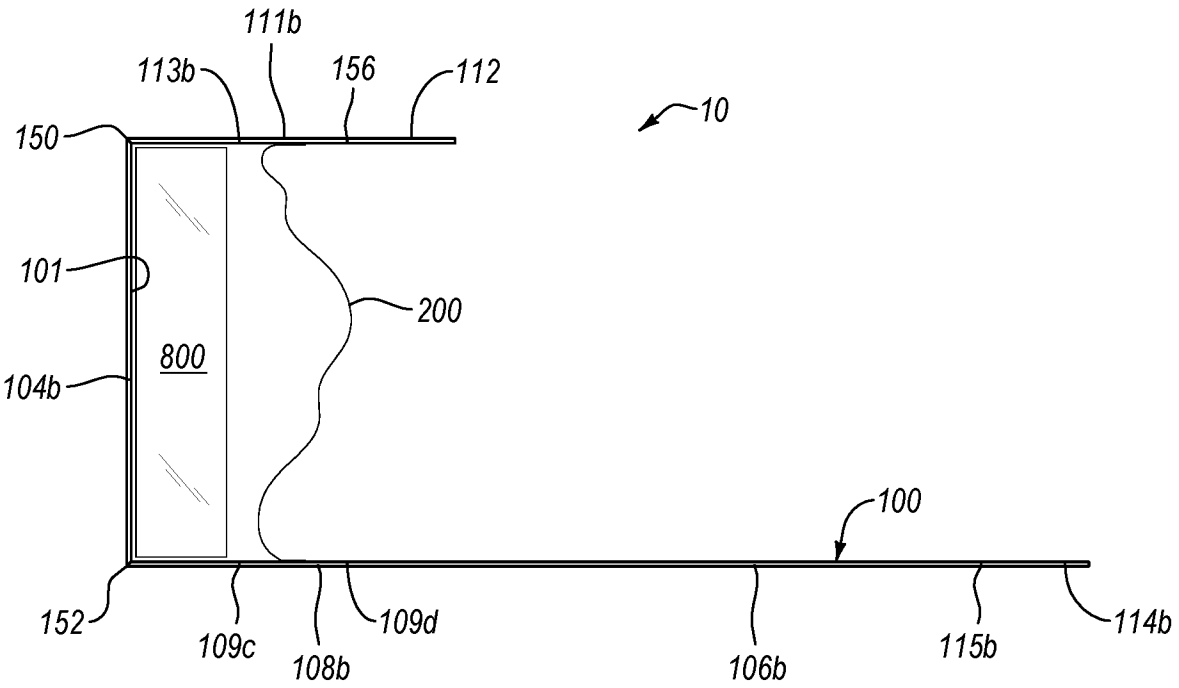
FIG. 2 illustrates a side elevation view of the retaining box template of FIG. 1 in a receiving configuration.
Figure 3A:
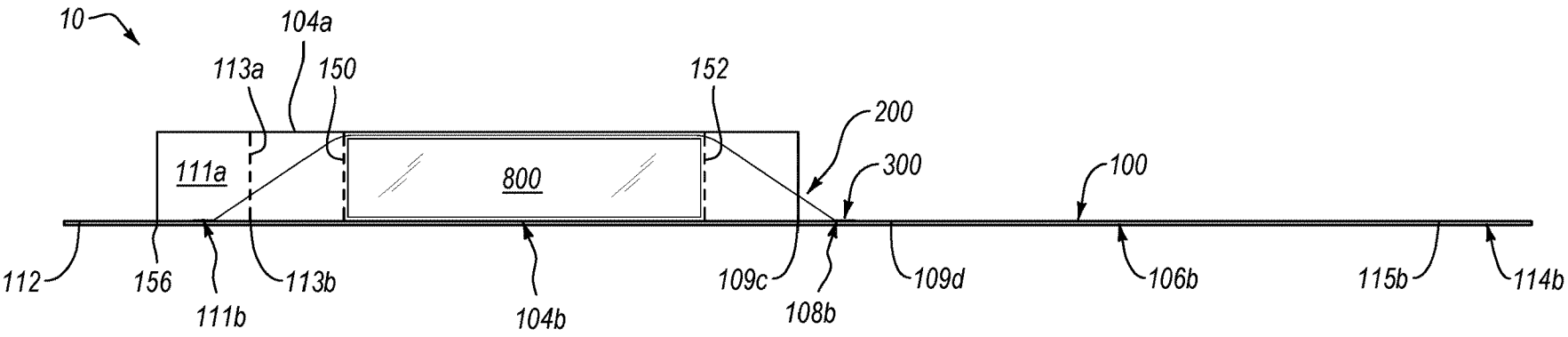
FIG. 3A illustrates a side elevation view of the retaining box template of FIG. 2 in a retaining configuration.
Figure 3B:
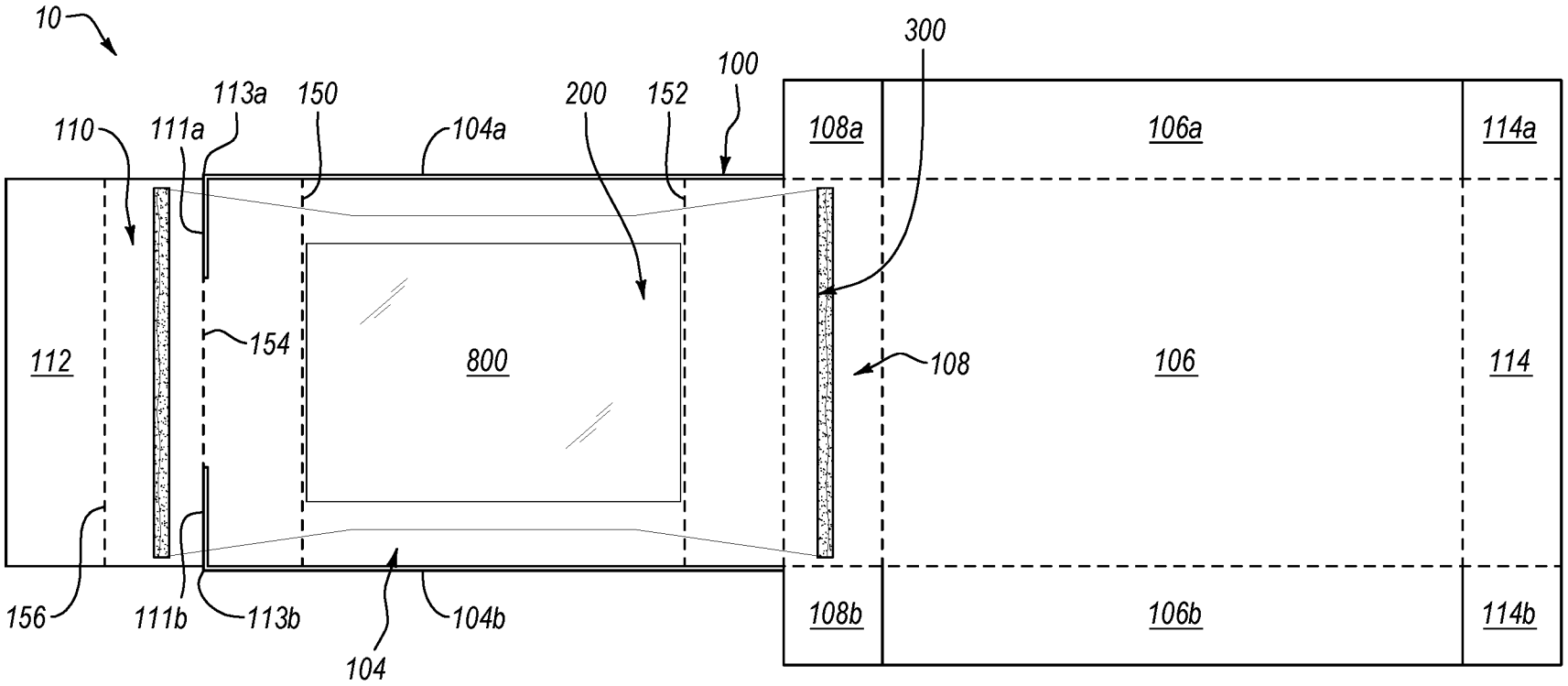
FIG. 3B illustrates a top plan view of the retaining box template of FIG. 3A in a first partially-folded configuration.
Figure 3C:
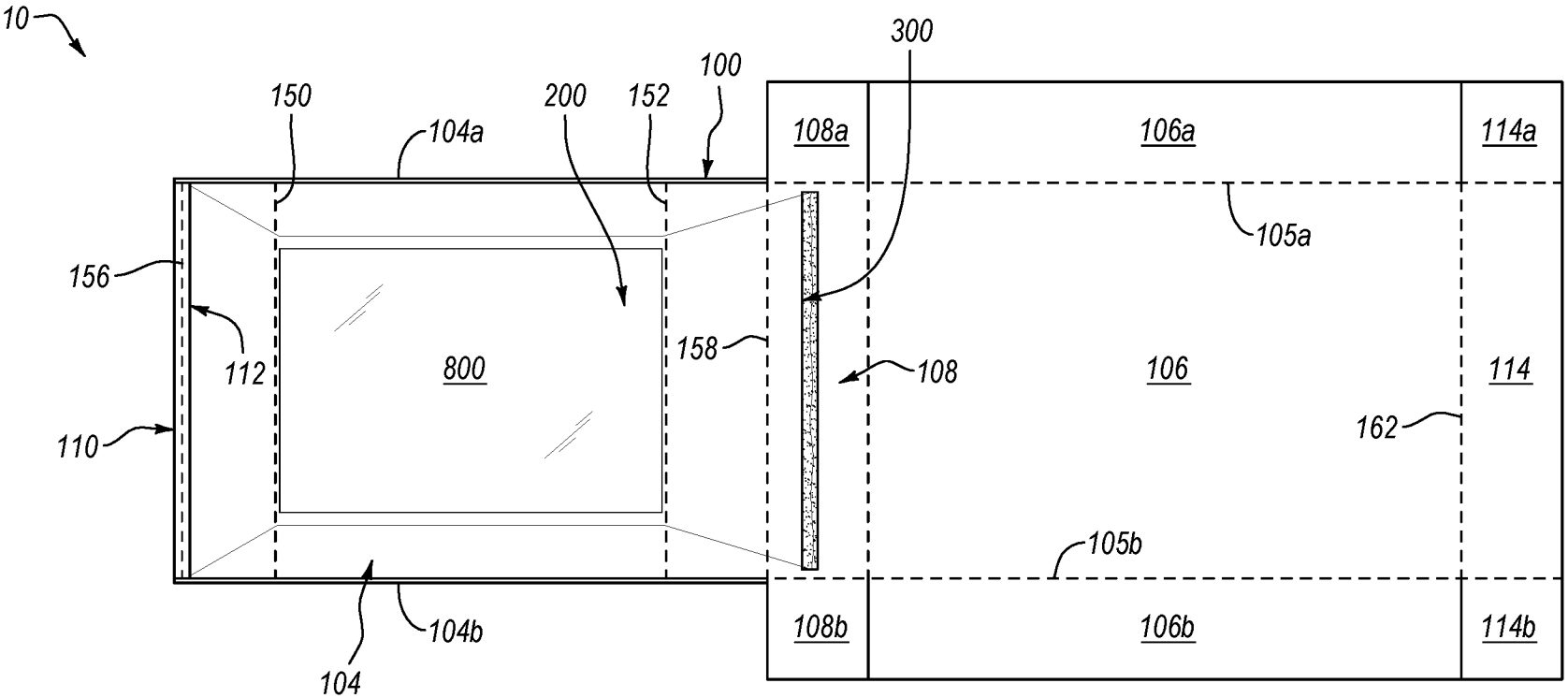
FIG. 3C illustrates a top plan view of the retaining box template of FIG. 3A in a second partially-folded configuration.
Figure 3D:
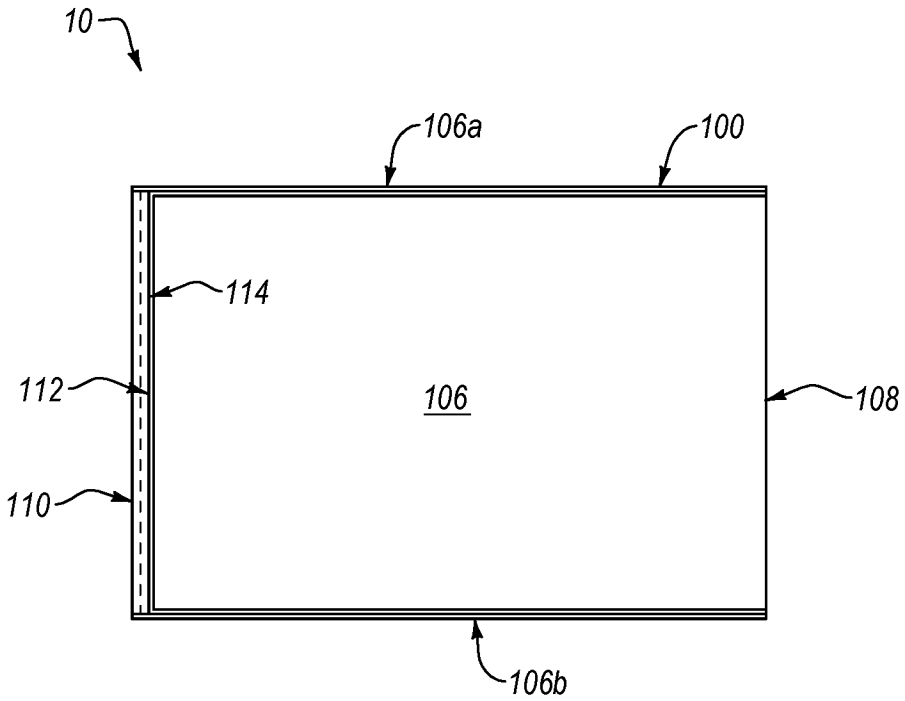
FIG. 3D illustrates a top plan view of the retaining box template of FIG. 3A in a third folded configuration.

Another embodiment includes a method of retaining a product in a box, illustratively depicted in FIGS. 2 through 3D and with continued reference to FIG. 1. The method can include providing template 10, folding sheet material 100 along at least first transverse crease 150, thereby increasing the distance between a portion of retaining element 200 and receiving area 105, base panel 104, and/or front surface 101 of the sheet material 100. For instance, as illustrated in FIG. 2, sheet material 100 can be folded at first transverse crease 150 and second transverse crease 152 to effectively loosen and/or create slack in retaining element 200 such that retaining element 200 moves away from a portion of sheet material 100. First transverse crease 150 and second transverse crease 152 can be folded to right angles, as depicted, or to any suitable obtuse angle or acute angle. Additional creases (e.g., 156; 113*a*, 113*b*, and/or 154; 158; 160; 162, 105*a*, and/or 105*b*) can be maintained in an unfolded configuration such that other panels (e.g., 112, 110, 111*a*, 111*b*, 108, 108*a*, 108*b*, 106, 106*a*, 106*b*, 114, 114*a*, and/or 114*b*) or portions of sheet material 100 are maintained in a planar configuration. It will be appreciate, however, that the one or more additional creases may be folded as desired.

A product 800 can be placed (e.g., inserted) in receiving area 105, against front surface 101 and/or between the portion of retaining element 200 and the portion of front surface 101. It will be appreciated that while FIG. 2 illustrates a side elevation view of template 10, with base panel 104 and side wall panels 104*a*, 104*b* in a vertical orientation such that retaining element 200 loops outward, to the side, template 10 can be oriented in any suitable manner. For instance, base panel 104 may be place on top such that retaining element 200 loops downward or on the bottom such that retaining element 200 loops upward without necessarily departing from the scope of this disclosure.

As illustrated in FIGS. 3A-3D, the method can also include manipulating sheet material 100 such that retaining element 200 secures product 800 against front surface 101 and/or within retaining area 105. In at least one embodiment, for example, manipulating sheet material 100 can include flattening sheet material 100 along first transverse crease 150 and second transverse crease 152 such that base panel 104 and side wall panels 104*a*, 104*b* are in a substantially planar configuration. Straightening sheet material 100 along first transverse crease 150 and second transverse crease 152 can decrease the distance between the portion of retaining element 200 and front surface 101 of sheet material 100 such that retaining element 200 is tightened and/or stretched over product 800 as sheet material 100 is flattened.

Sheet material 100 can also be folded at first longitudinal crease 105*a* as illustrated in FIG. 3A such that first side wall panel 104*a* is folded upward (towards product 800 and/or front surface 101) into an erected configuration (e.g., perpendicular to base panel 104). Folding first side wall panel 104*a* can straighten first transverse crease 150 and second transverse crease 152 and/or retain base panel 104 in the substantially planar configuration (with first transverse crease 150 and second transverse crease 152 in a straightened configuration). Accordingly, retaining element 200 can be drawn substantially tight over the top of product 800 and maintained in the tightened and/or stretched configuration by folding at least first side wall panel 104*a*.

As illustrated in FIG. 3B, second side wall panel 104*b* can also be folded upward along crease 105*b* into an erected configuration. Side wall tabs 111*a* and 111*b* can also be folded (inward) along respective creases 113*a* and 113*b* (over the top of retaining element 200). FIG. 3C further illustrates that side wall panels 104*a* and 104*b* and side wall tabs 111*a* and 111*b* can be secured in their folded configurations by folding front wall panel 110 upward along crease 154 into an erected configuration and folding securing flap 112 downward along crease 156 substantially against side wall tabs 111*a* and 111*b* and/or substantially parallel to front wall panel 110. This folding can also further tighten and/or stretch retaining element 200 in certain embodiments as retaining element 200 is pulled toward the distal edge of securing flap 112 into the interface between securing flap 112 and front wall panel 110.

It is noted that in such a configuration, template 10 and/or sheet material 100 thereof can be configured into a box with an open lid. Accordingly, product 800 can be retained and/or displayed in receiving area 105 by retaining element 200 while the box (i.e., folded template 10 and/or sheet material 100 thereof) is in the open configuration. In some embodiments, therefore, product 800 can be displayed when the box is opened by a receiving individual. Furthermore, product 800 may not fall out of the box if it is accidentally opened up-side-down or in another orientation.

As illustrated in FIG. 3D, lid panel 106 can be closed over the top of product 800. For instance, end wall 108 can be folded upward (toward front surface 101) at crease 158 into an erected configuration. End wall tabs 108*a* and 108*b* can be folded inward at longitudinal creases 105*a* and 105*b*, respectively, and disposed inside or outside erected side walls 104*a* and 104*b*, respectively. Longitudinal lid flaps 106*a* and 106*b* can also be folded (inward, toward front surface 101) at longitudinal creases 105*a* and 105*b*, respectively, and disposed inside or outside erected side walls 104*a* and 104*b*, respectively. Transverse lid flap 114 can also be folded (inward, toward front surface 101) at transverse crease 162 and disposed inside folded securing flap 112 or outside erected front wall 110. Lid flap tabs 114*a* and 114*b* can also be folded (inward, toward front surface 101) at longitudinal creases 105*a* and 105*b*, respectively, and disposed inside folded securing flap 112 or outside erected front wall 110.

Template 10 and/or sheet material 100 thereof can, thus, be folded into a box, whereby product 800 can be retained therein by retaining element 800.

Figure 4A:
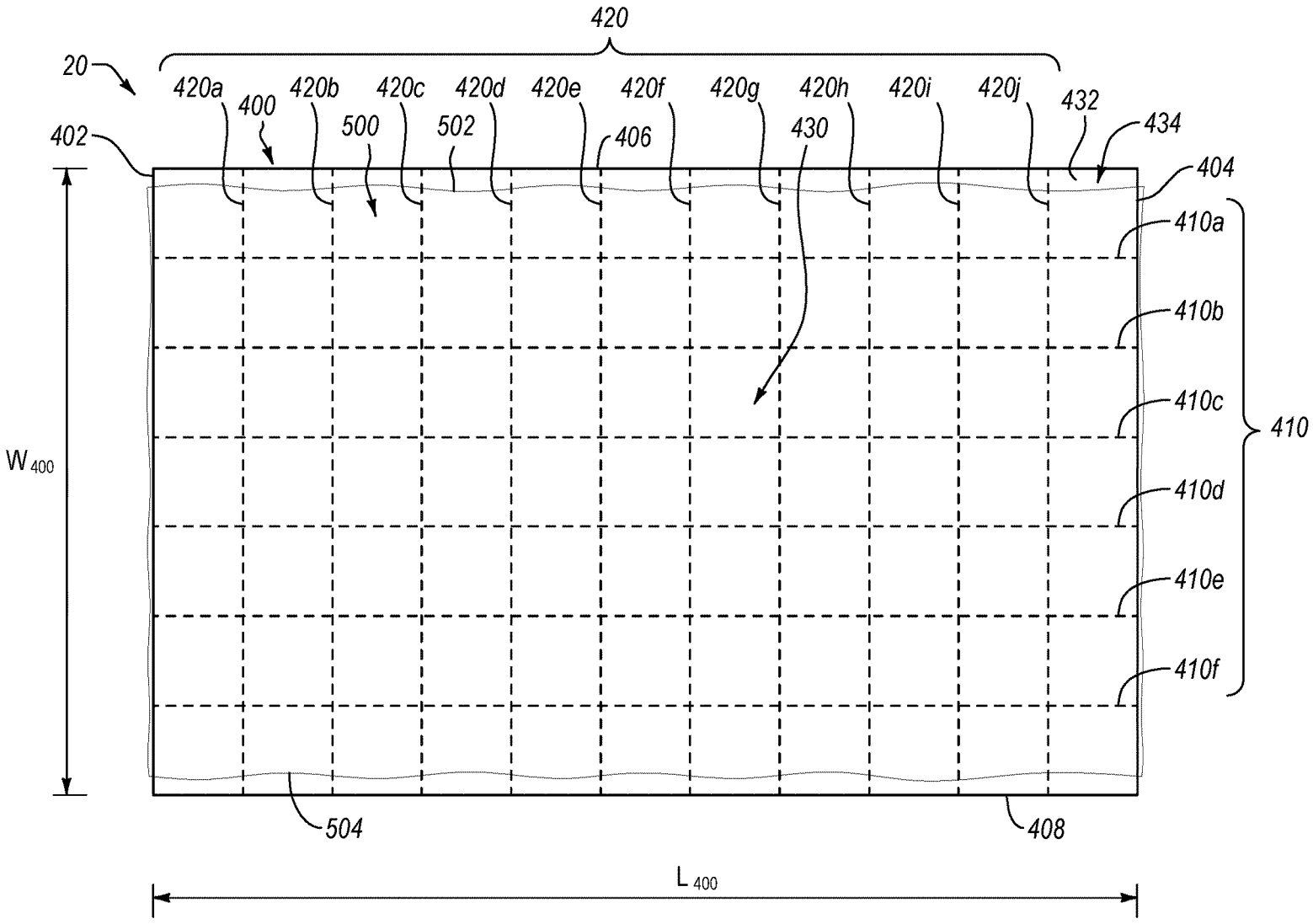
FIG. 4A illustrates a top plan view of a foldable retaining box insert template according to an exemplary embodiment of the present disclosure.
Figure 4B:
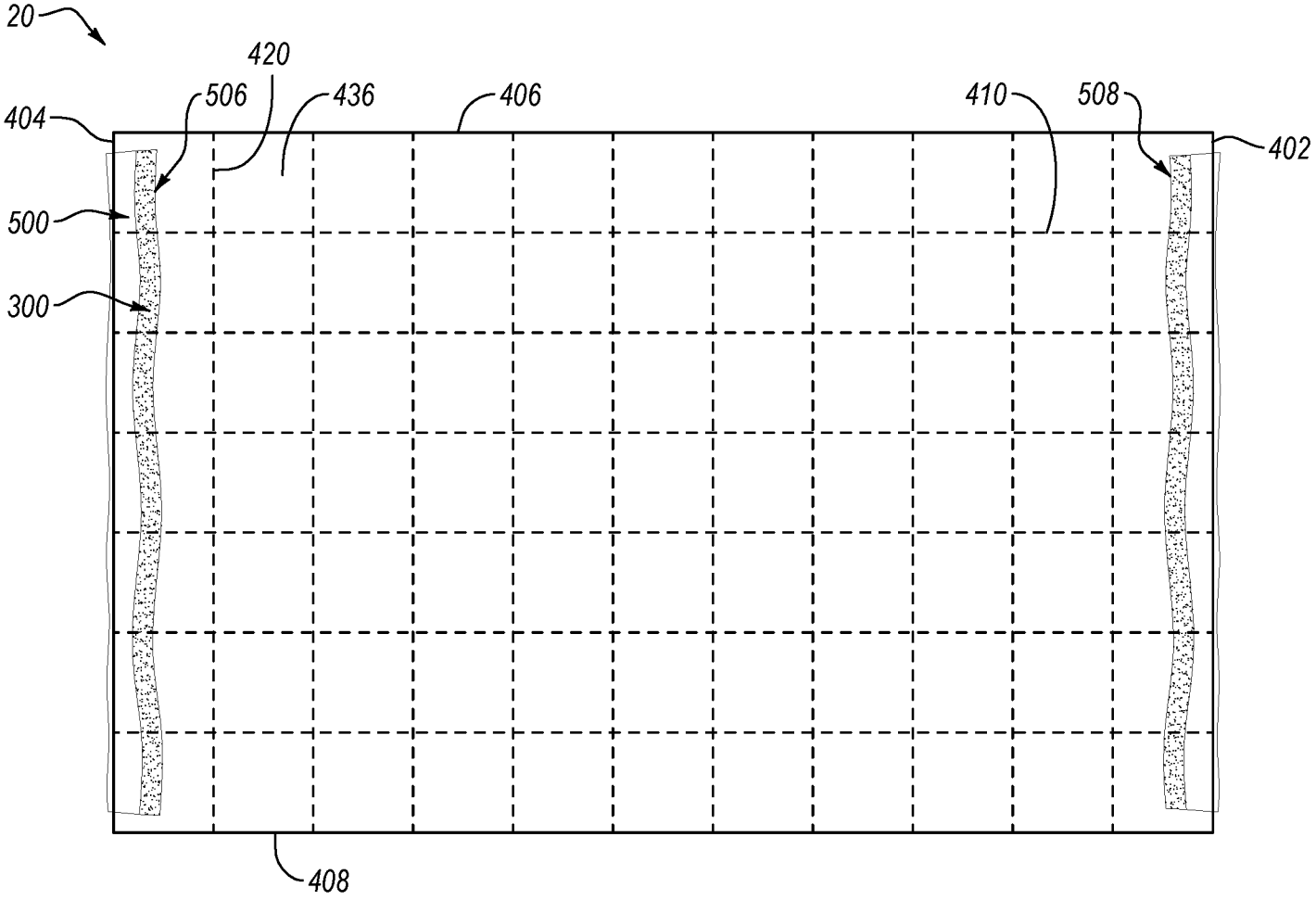
FIG. 4B illustrates a bottom plan view of the retaining box insert template of FIG. 4A.

In yet another embodiment, a foldable template for forming a customized product retainer box insert configured to retain products of various sizes is provided. As illustrated in FIGS. 4A and 4B, for instance, a foldable template 20 can include a (substantially rectangular shaped) sheet material 400 having a longitudinal length $L_{400}$, a transverse width $W_{400}$, a front surface 432, an opposing back surface 436, a plurality of longitudinal creases 410 extending between a first side 402 and an opposing second side 404 of sheet material 400, and/or a plurality of transverse creases 420 extending between an upper side 406 and an opposing lower side 408 of sheet material 400. In one or more embodiments, the plurality of longitudinal creases 410 can be disposed substantially parallel one to another at substantially and/or at substantially right-angles (i.e., 90 degrees) relative to the plurality of transverse creases 420.

It will be appreciated that foldable template 20 and/or sheet material 400 thereof need not have a (completely or perfectly) rectangular perimeter or outer shape. For instance, foldable template 20 and/or sheet material 400 thereof can have one or more rounded, curved, angles, notched, protruding, or altered edges, corners, or configurations (thereof). In some embodiments, foldable template 20 and/or sheet material 400 thereof can comprise a base portion or base format (e.g., disposed within the perimeter (or interior to the outer edges) of the foldable template 20 and/or sheet material 400 thereof). In at least one embodiment, the (inner) base portion or base format can have a substantially rectangular shape or configuration. It will also be appreciated that the plurality of longitudinal creases 410 and/or the plurality of transverse creases 420 can extend (entirely or at least partially) across the base portion or base format in one or more embodiments.

The plurality of longitudinal creases 410 can include a pair of outer longitudinal creases and at least one inner longitudinal crease disposed between the opposing outer longitudinal creases. For instance, crease 420*a* can comprise a first outer crease, crease 420*j* can comprise a second outer crease, and any of creases 420*b* through 420*i* can comprise an inner crease. Alternatively, any of creases 420 can comprise a first outer crease because selection of a second outer crease can determine the number of inner creases. The plurality of transverse creases 420 can also include a pair of outer transverse creases and at least one inner transverse crease disposed between the opposing outer transverse creases, similar to the longitudinal creases.

In some embodiments, the plurality of longitudinal creases 410 and/or plurality of transverse creases 420 can be spaced evenly apart between the opposing first and second sides 402, 404 and the opposing upper and lower sides 406, 408 of sheet material 400. It will be appreciated, however, that uneven spacing of creases 410, 420 is also contemplate herein. In certain embodiments, the plurality of longitudinal creases 410 can include at least three, four, five, six, seven, eight, nine, ten, twenty, or more longitudinal creases 410. Similarly, the plurality of transverse creases 420 can include at least three, four, five, six, seven, eight, nine, ten, twenty, or more transverse creases 420, in some embodiments. Between any of creases 410 and 420 can be a product receiving area 430. In some embodiments, receiving area 430 can be adjustable (larger or smaller) depending upon the size of a product to be placed therein and/or the selected creases 410 and/or 420.

Template 20 can also include a retaining element 500 connected to sheet material 400. It will be appreciated that retaining element 500 can have features similar to retaining element 200. Accordingly, the description of retaining element 200 can also apply to retaining element 500. For instance, retaining element 500 can also comprise a non-opaque material, such as a clear, polymeric stretch film, a translucent material, and/or other polymeric sheets. In some embodiments, retaining element 500 can have elastomeric properties suitable for being stretched in at least one (longitudinal) direction. Furthermore, retaining element 500 can be disposed over at least a portion of front surface 432 and/or can extend across the plurality of longitudinal creases 410 and/or the plurality of transverse creases 420.

Retaining element 500 can have a first longitudinal edge 502 and an opposing second longitudinal edge 504. As depicted in FIG. 4A, longitudinal edges 502 and 504 can be disposed, respectively, adjacent to upper side 406 and an opposing lower side 408 of sheet material 400. In an alternative embodiment, however, longitudinal edge 502 and/or 504 may be disposed inward of upper side 406 and opposing lower side 408 of sheet material 400, respectively. Thus, longitudinal edges 502 and 504 may not extend beyond (or past) upper side 406 and opposing lower side 408, respectively. In an alternative embodiment, however, longitudinal edges 502 and 504 may extend beyond (or past) upper side 406 and opposing lower side 408, respectively. In addition, in at least one embodiment, at least one longitudinal side edge 502, 504 of retaining element 500 can be substantially unattached to sheet material 500 (e.g., between any first transverse crease 420 and any second transverse crease 420).

Retaining element 500 can be attached to any suitable portion of sheet material 400. For instance, as depicted in FIG. 4B, a first portion 506 of retaining element 500 can be wrapped around side edge 404 and/or attached to rear surface 436 of sheet material 400 (e.g., between side edge 404 and any crease 420). However, first portion 506 of retaining element 500 can alternatively be attached to front surface 432 in other embodiments. A second portion 508 of retaining element 500 can also be wrapped around side edge 402 and/or attached to rear surface 436 of sheet material 500 (e.g., between side edge 402 and any crease 420). However, second portion 508 of retaining element 500 can alternatively be attached to front surface 432 in other embodiments. Retaining element 500 can be attached to sheet material 400 by means of at least one fastener 300, as described above.

First portion 506 and second portion 508 need not be attached to the same surface and/or at the same relative position relative to side edges 404, 402, respectively. Thus, first portion 506 (and/or second portion 508) can be attached between edge 404 (and/or 402) and any selected and/or suitable crease 420.

Yet another embodiment includes a method of retaining a product in a box, illustratively depicted in FIGS. 5 through 10 and with continued reference to FIGS. 4A and 4B. The method can include providing template 20 and placing a product 800*a* between a portion of retaining element 500 and a portion of front surface 432 of sheet material 400 (e.g., between two longitudinal creases 410 and/or between two transverse creases 420). For instance, product 800*a* can be inserted between retaining element 500 and front surface 432 and/or placed in receiving area 430.

Figure 5:
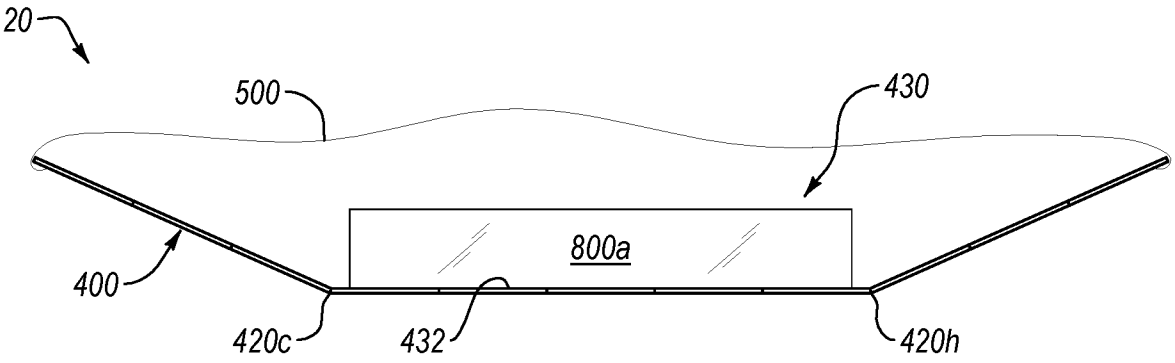
FIG. 5 illustrates a side elevation view of the retaining box insert template of FIG. 4A in a receiving configuration with a product received therein.

Certain embodiments can also include folding sheet material 400 along at least one transverse crease 420 (at any suitable angle), in a first direction, thereby increasing the distance between a portion of retaining element 500 and receiving area 430 and/or front surface 432 of the sheet material 400. For instance, as illustrated in FIG. 5, sheet material 400 can be folded at a first selected transverse crease 420*c* and a second selected transverse crease 420*h* (to effectively loosen and/or create slack in retaining element 500 such that retaining element 500 moves away from a portion of sheet material 400, making additional room or space for the placement of product 800*a*). It will be appreciated, however, that sheet material 400 can be folded along any suitable number of creases. Accordingly, one or more additional creases 420 may be folded as desired.

Figure 6:
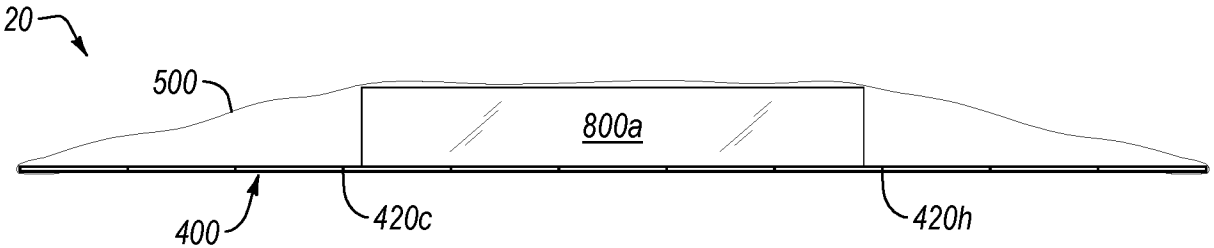
FIG. 6 illustrates a side elevation view of the retaining box insert template of FIG. 5 in a planar retaining configuration.

As depicted in FIG. 6, the folded crease or creases (e.g., creases 420*c* and 420*h*) can be straightened or unfolded (in a second direction opposite the first direction). In certain embodiments, retaining element 500 can be at least partially tightened and/or pulled over product 800*a* as sheet material 400 is straightened (at the one or more creases).

Figure 7:
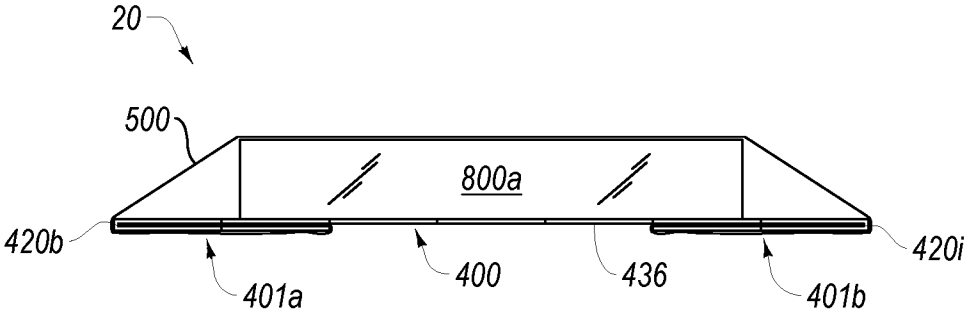
FIG. 7 illustrates a side elevation view of the retaining box insert template of FIG. 5 in a first folded configuration.

As illustrated in FIG. 7, the method can also include selecting from among the plurality of transverse creases 420 a first selected transverse crease 420*b* disposed peripheral to a first side of product 800*a* and/or a second selected transverse crease 420*i* disposed peripheral to a second side of product 800*a* opposite the first side of product 800*a*. The selected transverse creases can be the same or different creases discussed in connection with FIGS. 5 and 6 above. Furthermore, the method can include manipulating sheet material 400 such that retaining element 500 secures product 800*a* within receiving area 430 and/or against front surface 432. In certain embodiments, manipulating sheet material 432 can include folding sheet material 400 at the first selected transverse crease 420*b* and/or the second selected transverse crease 420*i* (in the second direction) such that a first portion 401*a* of sheet material 400 peripheral to first selected transverse crease 420*b* and/or a second portion 401*b* of sheet material 400 peripheral to second selected transverse crease 420*i* are folded substantially against back surface 436. It will be appreciated, however, that any suitable crease 420 or combination of creases 420 can be selected and/or folded as part of manipulating sheet material 400. Accordingly, one or more additional creases 420 may be folded as desired.

In at least one embodiment, manipulating sheet material 400 (further) tightens and/or stretches retaining element 500 over product 800*a* as sheet material 400 is folded at first selected transverse crease 420*b* and/or second selected transverse crease 420*i* (in the second direction). Thus, retaining element 500 can retain and/or maintain product 800*a* within receiving area 430 and/or against front surface 432.

Figure 8:
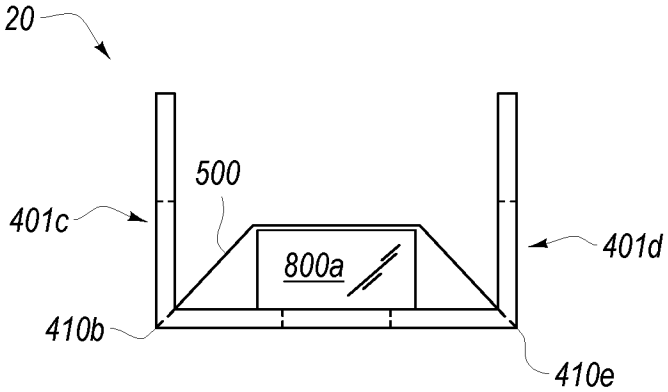
FIG. 8 illustrates a side elevation view of the retaining box insert template of FIG. 5 in a second folded configuration.

As depicted in FIG. 8, illustrating the manipulated and/or folded template 20 and/or sheet material 400 turned 90 degrees, the method can also include selecting from among the plurality of longitudinal creases 410 a first selected longitudinal crease 410*b* (disposed peripheral to a first, upper side of product 800*a*) and/or a second selected longitudinal crease 410*e* (disposed peripheral to a second, lower side of product 800*a* opposite the upper side of the product). In addition, manipulating sheet material 400, as described above, can further comprise folding sheet material 400 at first selected longitudinal crease 410*b* and/or second selected longitudinal crease 410*e* (in the first direction). Accordingly, a third portion 401*c* of sheet material 400 peripheral to first selected longitudinal crease 410*b* and/or a fourth portion 410*d* of sheet material 400 peripheral to second selected longitudinal crease 410*e* can be folded upward (e.g., towards front surface 432 and/or in the first direction) thereby securing first portion 401*a* and/or second portion 401*b* of sheet material 400 substantially against back surface 436 such that retaining element 500 remains stretched over product 800*a*. In other embodiments, the third and/or fourth portions 401*c*, 401*d* can be folded in a second direction (e.g., downward, toward back surface 436).

Figure 9:
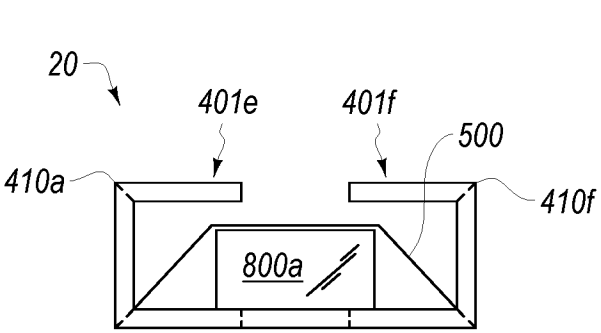
FIG. 9 illustrates a side elevation view of the retaining box insert template of FIG. 5 in a third folded configuration.

In one or more embodiments, and as illustrated in FIG. 9, the method can also include selecting from among the plurality of longitudinal creases 410 a third selected longitudinal crease 410*a* (e.g., disposed in third portion 401*c* of sheet material 400) and/or selecting from among the plurality of longitudinal creases 410 a fourth selected longitudinal crease 410*f* (e.g., disposed in fourth portion 401*d* of sheet material 400). In addition, manipulating sheet material 400 can further include folding sheet material 400 at third selected longitudinal crease 410*a* (in the second direction) such that a part 401*e* of third portion 401*c* is folded (downward) towards front surface 432 and/or folding sheet material 400 at fourth selected longitudinal crease 410*f* (in the second direction) such that a part 401*f* of fourth portion 401*d* is folded (downward) towards front surface 432.

Figure 10:
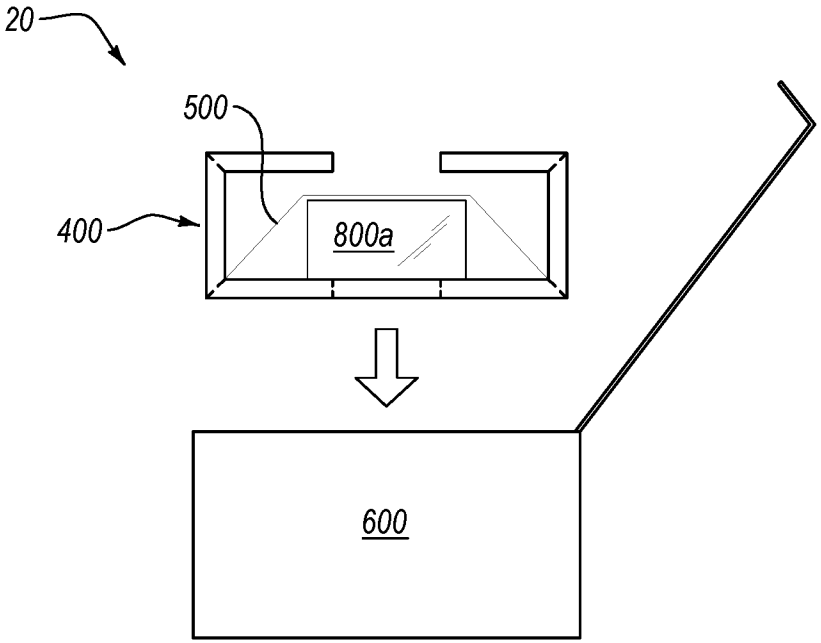
FIG. 10 illustrates a side elevation view of the retaining box insert template of FIG. 9 being inserted into a box.

As illustrated in FIG. 10, the method can also include placing the manipulated and/or folded template 20 into a box 600. Box 600 can be sized to fit manipulated and/or folded template 20. Alternatively, template 20 can be manipulated and/or folded to fit within box 600. Those skilled in the art will appreciate in light of the disclosure provided herein, that folding creases 410 and/or 420 adjacent to product 800*a* may be desirable in certain embodiments in order to reduce the size of manipulated and/or folded template 20, thereby reducing the required size of box 600. Thus, template 20 can comprise a customizable, foldable box insert template. In addition, as noted above, retaining element 500 can secure and/or display product 800*a* within box 600.

Figure 11:
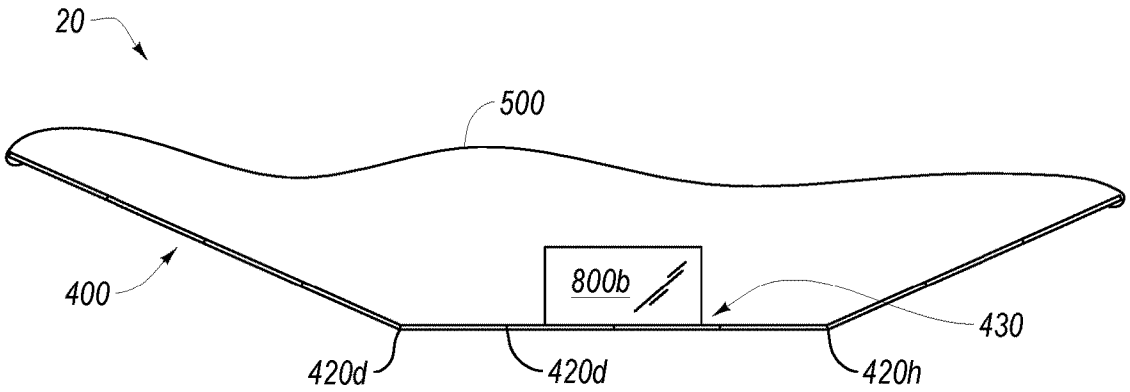
FIG. 11 illustrates a side elevation view of the retaining box insert template of FIG. 4A in a receiving configuration with a smaller product received therein.
Figure 13:
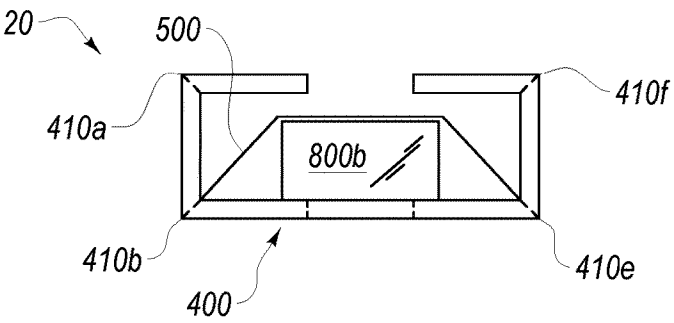
FIG. 13 illustrates a side elevation view of the retaining box insert template of FIG. 11 in a second folded configuration.
Figure 12:
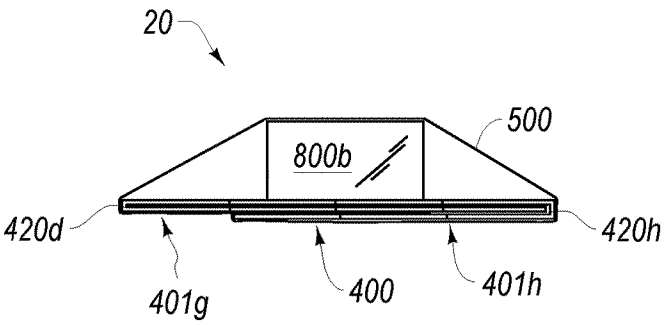
FIG. 12 illustrates a side elevation view of the retaining box insert template of FIG. 11 in a first folded configuration.

FIGS. 11-13 further illustrate that template 20 can accommodate various sizes of products. For instance, as depicted in FIG. 11, a product 800*b* (smaller than product 800*a* in at least one direction) can be positioned in receiving area 430. Product 800*b* can then be secured and/or displayed in receiving area 430 by retaining element 500 by folding sheet material 400 at creases 420*d* and 420*h* such that portions 401*g* and 401*h* overlap under sheet material 400, at least one of portion 401*g* and 401*h* being folded against rear surface 436, as illustrated in FIG. 12. Template 20 can then be further manipulated by folding along one or more longitudinal creases 410 as illustrated in FIG. 13 and described previously to reduce the size of folded template 20 and make folded template 20 suitable for insertion into box 600.

The foregoing detailed description makes reference to specific exemplary embodiments. However, it will be appreciated that various modifications and changes can be made without departing from the scope contemplated herein and as set forth in the appended claims. In particular, while illustrative exemplary embodiments in this disclosure have been more particularly described, the present disclosure is not limited to these embodiments, but includes any and all embodiments having modifications, omissions, combinations (e.g., of aspects across various embodiments), adaptations and/or alterations as would be appreciated by those in the art based on the foregoing detailed description. The limitations in the claims are to be interpreted broadly based on the language employed in the claims and not limited to examples described in the foregoing detailed description, which examples are to be construed as non-exclusive.

Moreover, any steps recited in any method or process described herein and/or recited in the claims may be executed in any order and are not necessarily limited to the order presented in the claims, unless otherwise stated (explicitly or implicitly) in the claims. Accordingly, the scope of the invention should be determined solely by the appended claims and their legal equivalents, rather than by the descriptions and examples given above.

It will also be appreciated that various features, members, elements, parts, and/or portions of certain embodiments of the present invention are compatible with and/or can be combined with, included in, and/or incorporated into other embodiments of the present invention. Thus, disclosure a certain features, members, elements, parts, and/or portions relative to a specific embodiment of the present invention should not be construed as limiting application or inclusion of said features, members, elements, parts, and/or portions to the specific embodiment. Rather, it will be appreciated that other embodiments can also include said features, members, elements, parts, and/or portions without necessarily departing from the scope of the present invention. Likewise, certain embodiments can include fewer features than those disclosed in specific examples without necessarily departing from the scope of this disclosure.

In addition, the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A foldable template for forming a product retaining box, comprising:

a sheet material having a front surface, the sheet material comprising:

a base panel having a perimeter comprising a first transverse edge, a second transverse edge opposite the first transverse edge, an upper longitudinal edge extending between the first and second transverse edges, and a lower longitudinal edge extending between the first and second transverse edges opposite the upper longitudinal edge;

a first side wall panel connected to the base panel and extending from the upper longitudinal edge;

a first longitudinal crease disposed between the base panel and the first side wall panel; and first and second transverse creases separated by a first longitudinal length, the first and second transverse creases being disposed between the first and second transverse edges of the base panel and extending from the lower longitudinal edge across the first longitudinal crease and into the first side wall panel, an area on the front surface between the first and second transverse creases and between the upper and lower longitudinal edges comprising a product receiving area;

an end wall panel connected to the base panel and extending from the first transverse edge;

a lid panel connected to the end wall panel and extending opposite the base panel, such that the end wall panel is disposed between the base panel and the lid panel;

a front wall panel connected to the base panel and extending from the second transverse edge opposite the end wall panel;

a securing flap connected to the front wall panel opposite the base panel;

a third transverse crease disposed between the base panel and the front wall panel;

a fourth transverse crease disposed between the front wall panel and the securing flap;

a fifth transverse crease disposed between the base panel and the end wall panel; and a sixth transverse crease disposed between the end wall panel and the lid panel and a retaining element disposed over at least a portion of the front surface and extending across the first and second transverse creases, the retaining element having a first portion and a second portion attached to the sheet material, the second portion being attached either to the base panel between the second transverse crease and the first transverse edge or to the end wall panel, the retaining element being connected to the sheet material such that:

folding the sheet material in a first direction along the first and second transverse creases increases a distance between the retaining element and the receiving area;

unfolding the sheet material along the first and second transverse creases such that the base panel is in a planar configuration decreases the distance between the retaining element and the receiving area; and folding the sheet material along the first longitudinal crease such that the first side wall panel is oriented perpendicular to the base panel retains the base panel in the planar configuration.

2. The foldable template of claim 1, wherein the first and second transverse creases extend from the lower longitudinal edge across the first longitudinal crease and entirely through the first side wall panel.

3. The foldable template of claim 1, wherein the sheet material further comprises:

a second side wall panel connected to the base panel and extending from the lower longitudinal edge; and a second longitudinal crease disposed between the base panel and the second side wall panel, the first and second transverse creases extending from the first side wall panel across the second longitudinal crease and into the second side wall panel, wherein folding the sheet material along the second longitudinal crease such that the second side wall panel is oriented perpendicular to the base panel retains the base panel in the planar configuration.

4. The foldable template of claim 3, wherein the first and second transverse creases extend from the first side wall panel across the second longitudinal crease and entirely through the second side wall panel.

5. The foldable template of claim 1, wherein the sheet material further comprises:

a first side wall tab extending from the first side wall panel;

a first tab crease disposed between the first side wall tab and the first side wall panel, the first tab crease substantially aligned with the third transverse crease;

a second side wall tab extending from the second side wall panel; and a second tab crease disposed between the second side wall tab and the second side wall panel, the second tab crease substantially aligned with the third transverse crease.

6. The foldable template of claim 1, wherein the sheet material further comprises one or more lid flaps connected to and extending from the lid panel.

7. The foldable template of claim 1, wherein at least one longitudinal side edge of the retaining element is substantially unattached to the sheet material between the first and second transverse creases.

8. The foldable template of claim 1, wherein the retaining element is attached to the sheet material by means of at least one fastener.

9. The foldable template of claim 7, wherein the at least one fastener comprises an adhesive.

10. The foldable template of claim 1, wherein the retaining element comprises a non-opaque material.

11. The foldable template of claim 1, wherein the retaining element comprises a stretchable polymeric film.

12. A foldable template for forming a product retaining box, comprising:

a sheet material having a front surface, the sheet material comprising:

a base panel having first and second transverse creases separated by a first longitudinal length, an area on the front surface between the first and second transverse creases comprising a product receiving area;

a lid panel connected to the base panel;

an end wall panel disposed between the base panel and the lid panel;

a front wall panel connected to the base panel opposite the end wall panel;

a securing flap connected to the front wall panel opposite the base panel;

a third transverse crease disposed between the base panel and the front wall panel;

a fourth transverse crease disposed between the front wall panel and the securing flap;

a fifth transverse crease disposed between the base panel and the end wall panel; and a sixth transverse crease disposed between the end wall panel and the lid panel; and a retaining element disposed over at least a portion of the front surface and extending across the first and second transverse creases, the retaining element being connected to the sheet material such that folding the sheet material along the first and second transverse creases increases a distance between the retaining element and the receiving area.

13. The foldable template of claim 12, wherein at least one longitudinal side edge of the retaining element is substantially unattached to the sheet material between the first and second transverse creases.

14. The foldable template of claim 12, wherein the base panel has a perimeter comprising a first transverse edge connected to the end wall panel, a second transverse edge connected to the front wall panel opposite the first transverse edge, an upper longitudinal edge extending between the first and second transverse edges, and a lower longitudinal edge extending between the first and second transverse edges opposite the upper longitudinal edge, the first and second transverse creases being disposed between the first and second transverse edges and extending from the upper longitudinal edge to the lower longitudinal edge.

15. The foldable template of claim 12, wherein the sheet material further comprises:

a first side wall panel connected to the base panel and extending from the upper longitudinal edge;

a first longitudinal crease disposed between the base panel and the first side wall panel;

a second side wall panel connected to the base panel and extending from the lower longitudinal edge; and a second longitudinal crease disposed between the base panel and the second side wall panel.

16. The foldable template of claim 15, wherein the sheet material further comprises:

a first side wall tab extending from the first side wall panel;

a first tab crease disposed between the first side wall tab and the first side wall panel;

a second side wall tab extending from the second side wall panel; and a second tab crease disposed between the second side wall tab and the second side wall panel.

17. The foldable template of claim 12, wherein the sheet material further comprises one or more lid flaps connected to and extending from the lid panel.

18. The foldable template of claim 12, wherein the retaining element comprises a non-opaque material.

19. The foldable template of claim 12, wherein the retaining element extends across the third transverse crease and/or the fifth transverse crease, the retaining element being connected to the front wall panel and/or to the end wall panel.

20. The foldable template of claim 12, wherein the retaining element is connected to the sheet material between the first transverse crease and the third transverse crease and/or between the second transverse crease and the fifth transverse crease.

21. The foldable template of claim 12, wherein the retaining element is connected to the sheet material at the third transverse crease and/or at the fifth transverse crease.

22. A foldable template for forming a customized product retainer box insert configured to retain products of various sizes, comprising:

a sheet material having:

a base format with a substantially rectangular shape; opposing front and back surfaces;

a plurality of longitudinal creases extending between opposing first and second sides of the base format, the plurality of longitudinal creases comprising a pair of outer longitudinal creases and at least one inner longitudinal crease disposed between the opposing outer longitudinal creases;

a plurality of transverse creases extending between opposing upper and lower sides of the base format, the plurality of transverse creases comprising a pair of outer transverse creases and at least one inner transverse crease disposed between the opposing outer transverse creases;

a receiving area disposed between at least two of the plurality of longitudinal creases and at least two of the transverse creases, a size of the receiving area being variable by folding the sheet material along different creases of the plurality of longitudinal creases or the plurality of transverse creases; and a retaining element connected to the sheet material, the retaining element disposed over at least a portion of the front surface and extending across at least a portion of the plurality of longitudinal creases and at least a portion of the plurality of transverse creases, wherein folding the sheet material along one or more of the creases in a first direction increases a distance between the retaining element and the front surface of the sheet material.

23. The foldable template of claim 22, wherein the at least one inner longitudinal crease comprises a plurality of inner longitudinal creases.

24. The foldable template of claim 22, wherein the at least one inner transverse crease comprises a plurality of inner transverse creases.

25. The foldable template of claim 22, wherein the plurality of longitudinal creases are spaced evenly apart between the opposing first and second sides of the sheet material and the plurality of transverse creases are spaced evenly apart between the opposing upper and lower sides of the sheet material.

26. The foldable template of claim 22, wherein the retaining element is wrapped around one or more of the opposing first and second sides and is attached to the back surface of the sheet material.

27. The foldable template of claim 26, wherein the retaining element is wrapped around the opposing first and second sides, a first portion of the retaining element being attached to the back surface of the sheet material adjacent to the first side and a second portion of the retaining element being attached to the back surface of the sheet material adjacent to the second side.

28. The foldable template of claim 22, wherein the retaining element is attached to the front surface of the sheet material.

29. The foldable template of claim 22, wherein the plurality of longitudinal creases includes at least six longitudinal creases.

30. The foldable template of claim 22, wherein the plurality of longitudinal creases includes at least eight longitudinal creases.

31. The foldable template of claim 22, wherein the plurality of transverse creases includes at least six transverse creases.

32. The foldable template of claims 22, wherein folding the sheet material along the one or more of the creases in a second direction decreases the distance between the retaining element and the front surface of the sheet material.

33. The foldable template of claim 22, wherein folding the sheet material along the one or more of the creases in the second direction such that a portion of the sheet material folds underneath the front surface pulls the retaining element tight over the receiving area.

34. The foldable template of claim 32, wherein folding the sheet material along one or more additional creases in the first direction such that a portion of the sheet material folds upward toward the front surface after the sheet material has been folded along the one or more creases in the second direction such that the portion of the sheet material folds underneath the front surface further tightens the retaining element over the receiving area and/or secures the retaining element pulled tight over the receiving area.

35. The foldable template of claim 34, wherein folding the sheet material along one or more additional creases in the first direction such that a portion of the sheet material folds upward toward the front surface after the sheet material has been folded along the one or more creases in the second direction such that the portion of the sheet material folds underneath the front surface forms a side wall extending upward from the front surface.

* * * * *